US005662232A

United States Patent [19]

Eguchi et al.

[11] Patent Number: 5,662,232

[45] Date of Patent: *Sep. 2, 1997

[54] CAPSULE

[75] Inventors: Tatsuo Eguchi; Yoshitaka Tamura, both of Shiga; Toshihiro Ueda, Osaka, all of Japan

[73] Assignee: Suntory Limited, Osaka, Japan

[ * ] Notice: The portion of the term of this patent subsequent to Oct. 17, 2012, has been disclaimed.

[21] Appl. No.: 497,378

[22] Filed: Jun. 30, 1995

Related U.S. Application Data

[63] Continuation of Ser. No. 378,323, Jan. 25, 1995, Pat. No. 5,458,251, which is a continuation of Ser. No. 30,270, filed as PCT/JP92/01003, Aug. 6, 1992, abandoned.

[30] Foreign Application Priority Data

Aug. 7, 1991 [JP] Japan ..... 3-70539 U

[51] Int. Cl.[6] ..... B65D 41/32

[52] U.S. Cl. ..... 215/254; 215/256

[58] Field of Search ..... 215/251, 253, 215/254, 256

[56] References Cited

U.S. PATENT DOCUMENTS

| | | | |
|---|---|---|---|
| 1,481,035 | 1/1924 | Stattmann | 215/251 |
| 1,712,102 | 5/1929 | Carvalho | 215/256 |
| 1,875,431 | 9/1932 | Fabrice | 215/251 |
| 2,806,620 | 9/1957 | Blanch | 215/251 |
| 2,954,139 | 9/1960 | Owens | 215/256 X |
| 4,109,816 | 8/1978 | Faulstich | 215/256 |
| 4,749,096 | 6/1988 | Thomas et al. | 215/256 |
| 4,805,792 | 2/1989 | Lecinski, Jr. | 215/253 |
| 5,103,989 | 4/1992 | Druesne et al. | 215/254 |
| 5,222,616 | 6/1993 | Druesne et al. | 215/256 |

*Primary Examiner*—Stephen K. Cronin
*Attorney, Agent, or Firm*—Jones, Tullar & Cooper, P.C.

[57] ABSTRACT

There is provided a capsule in which large and sharp burr is not easily formed in such case of unsealing. This capsule comprises a cap portion 1, a skirt portion 2, and a tearable guarantee strip 3. Weakening lines 4 and 5 are formed at a boundary between the tearable guarantee strip 3 and the cap portion 1, and at a boundary between the tearable guarantee strip 3 and the skirt portion 2. The weakening line 5 comprises linear compressed part 8 and saw-tooth-like compressed parts 9. The saw-tooth-like compressed parts 9 are formed so as to serrate from the linear compressed part 8 to the tearable guarantee strip 3 side. The saw-tooth-like compressed parts 9 may be also formed so as to serrate from the linear compressed part 8 to the skirt portion 2 side. The weakening line 5 may be also formed of a plurality of circular arc compressed parts each drawing an arc on the tearable guarantee strip 3 side and disposed with a certain distance. The weakening line 5 may be also formed of circular arc holes instead of circular arc compressed parts. The weakening line 4 may also comprise either linear compressed part 8 and saw-tooth-like compressed parts 9 or circular arc compressed parts only.

3 Claims, 4 Drawing Sheets

CAPSULE

This application is a continuation of application Ser. No. 08/378,323 filed Jan. 25, 1995, now U.S. Pat. No. 5,458,251, which is a continuation of application Ser. No. 08/030,270, filed as PCT/JP92/01003 Aug. 6, 1992, now abandoned.

BACKGROUND ART

The present invention relates to a bottle neck cover or capsule of the kind used to mount the upper parts of the neck of a bottle the mouth of which has been closed by a cork, screw-cap, bung or other form of closure, and exposed parts of the closure to provide a tamper-evidence cover for the closure, and an ornamental addition.

According to the present invention there is provided a bottle having a neck the mouth of which is closed by a bung, cork, screw-cap or other form of closure, the upper portions of the neck of the bottle and the exposed portion of the applied closure being covered, by a capsule formed from tin, aluminum or any of these materials laminated with, synthetic resin film. The sides of the capsule are deformed inwardly into close contact with the surface of the neck of the bottle and any exposed laterally-facing surface of the closure, whereby the capsule is retained on the closure and provides a tamper-evidence cover for the closure.

Hitherto, as illustrated in FIG. 1, a capsule comprises a cap portion 1, skirt portion 2, and a tearable guarantee strip 3 connecting the cap portion 1 and the skirt portion 2. Weakening lines 4 and 5 are provided, respectively, at a boundary between the tearable guarantee strip 3 and the cap portion 1, and at a boundary between the tearable guarantee strip 3 and the skirt portion 2. The weakening lines 4 and 5 are generally formed by compressing a capsule body in the direction of thickness like a perforation. Accordingly, when pulling the tearable guarantee strip 3 outwardly, the tearable guarantee strip 3 is gradually torn and removed along the weakening lines 4 and 5 due to less strength of these lines formed compressively like a perforation. After removing completely the tearable guarantee strip 3 and the cap portion 1, the bottle is unsealed or open.

In this respect, the conventional weakening lines 4 and 5 are formed as illustrated in FIG. 2. That is, saw-tooth-like compressed sections 6 are formed at the boundary between the tearable guarantee strip 3 and the cap portion 1 as well as at the boundary between the tearable guarantee strip 3 and the skirt portion 2. A problem, however exists in the mentioned removal of the tearable guarantee strip 3 as follows. That is, at the time of pulling the tearable guarantee strip 3 circumferentially and outwardly by picking up a bulge thereof, there arises a disadvantage that non-compressed parts 7 each located between one tooth and another of the saw-tooth-like compressed sections 6 protrudes outwardly from the circumference of the bottle.

Notwithstanding, the mentioned disadvantage has not been considered serious because lead is employed as a material for the capsule. More specifically, since lead is a relatively soft material, there is almost no possibility of feeling pain in a finger or injuring any finger in the case where the protrusions (i.e., burr) are touched. Recently, however, it has been pointed out that lead is disqualified for capsule material because lead is not suitable for health and is poisonous once it enters into the human body, resulting in lead poisoning and lead injury. It has been a recent trend to employ tin as a capsule material. Tin is a material harder than lead. Hence, the mentioned disadvantage of feeling pain or injuring a finger has become a serious problem. More specifically, in case of a tin capsule, there arises a serious problem of feeling pain in a finger or injuring a finger when touching a burr formed of the non-compressed parts 7. In particular, the skirt portion 2 is still left on the neck of the bottle after opening the bottle, being different from the tearable guarantee strip 3 and the cap portion 1 which are removed once the bottle is opened. As a result, the burr formed on the upper edge of the skirt portion 2 may cause pain in a finger or injure it when touching the burr at the time of handling the bottle. The situation is quite the same even when employing a soft aluminium which is also a material harder than lead.

DISCLOSURE OF THE INVENTION

Figure 1:
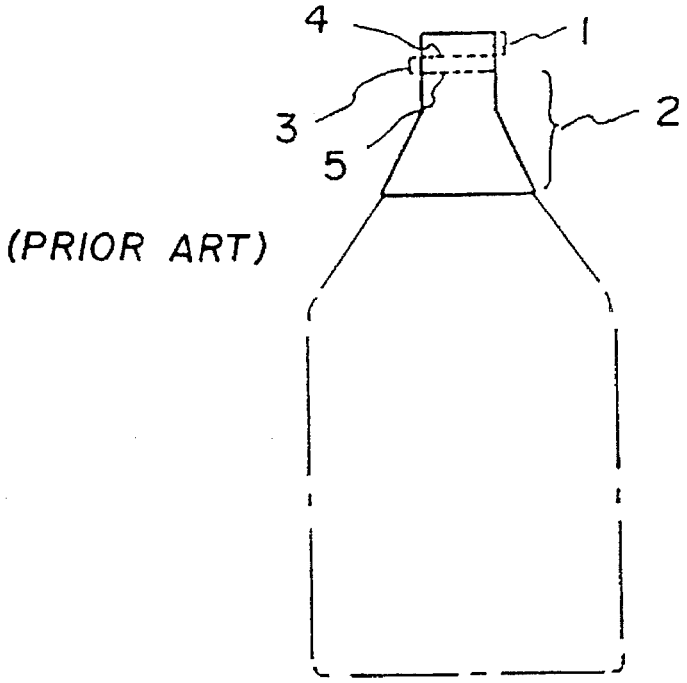
FIG. 1 is a front view of a known bottle neck cover or capsule.

The present invention was made to solve the above-discussed problem and has as an object providing an improved capsule of tin or soft aluminium in which burrs which would cause any finger to feel pain or to be injured, i.e., larger and sharp burrs, are not formed after tearing and removing the tearable guarantee strip.

To accomplish the foregoing object, in the capsule according to the present invention, each of the weakening lines comprises a linear compressed part forming a boundary between a tearable guarantee strip and a skirt portion, and saw-tooth-like compressed parts serrating from the linear compressed part to the tearable guarantee strip side. The saw-tooth-like compressed parts may serrate to the skirt portion side instead of serrating to the tearable guarantee strip side.

To accomplish the foregoing object, each of the weakening lines comprises circular arc compressed parts each drawing an arc on the tearable guarantee strip side so that the circular arc compressed parts are located at the boundary between the tearable guarantee strip and the skirt portion with a certain distance between one circular arc and another. Instead of the circular arc compressed parts, circular arc perforated parts may be located at the boundary between the tearable guarantee strip and the skirt portion.

The capsule according to the present invention comprises a cap portion 1, a skirt portion 2 and a tearable guarantee strip 3 connecting the cap portion 1 and the skirt portion 2. The capsule is hollow so as to be mounted on the neck of the bottle. Since the neck of the bottle, is, in general, almost cylindrical, the cap portion 1 is a cylinder having a top transverse surface, while the tearable guarantee strip 3 and the skirt portion 2 are cylinders without a top transverse surface.

For opening or unsealing the bottle, a bulge of the tearable guarantee strip 3 is pulled circumferentially and outwardly, and the tearable guarantee strip is torn along each of the weakening lines. Then, the cap portion 1 is removed to expose the closure which is then opened. Accordingly, the weakening lines 4 and 5 are formed at the boundary between the tearable guarantee strip 3 and the cap portion 1 as well as at the boundary between the tearable guarantee strip 3 and the skirt portion 2 so that the tearable guarantee strip 3 is easily removed at the time of pulling it. The present invention is principally characterized by the construction arrangement of the weakening line 5 as described hereinafter.

Figure 3:
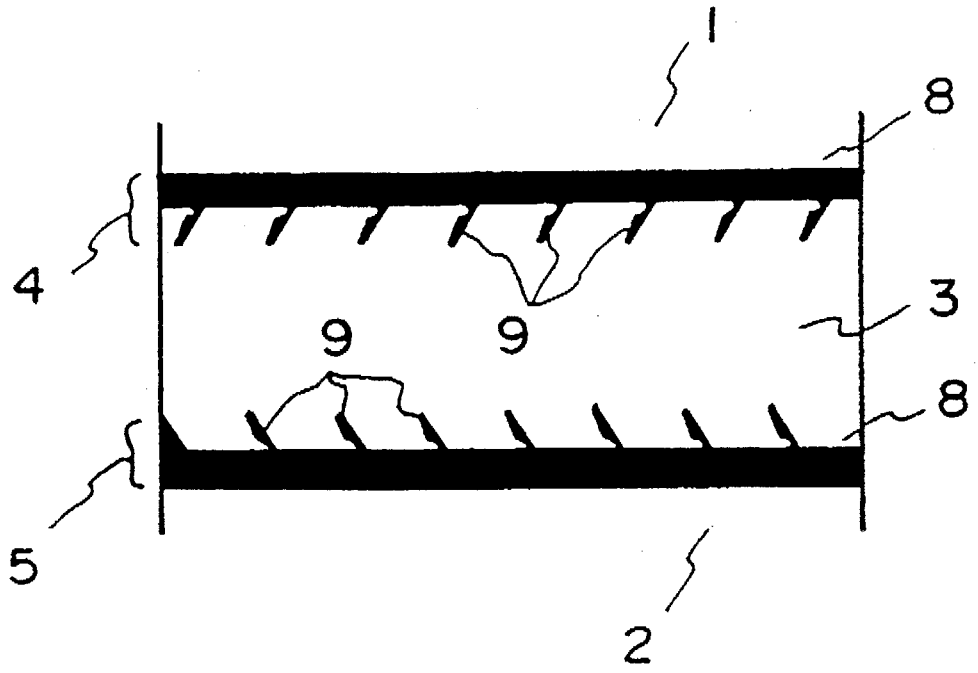
FIG. 3 is an enlarged front view showing a tearable guarantee strip and adjacent portions of the capsule according to an example of the present invention, and in which each weakening line comprises linear compressed part and saw-tooth-like compressed parts.
Figure 4:
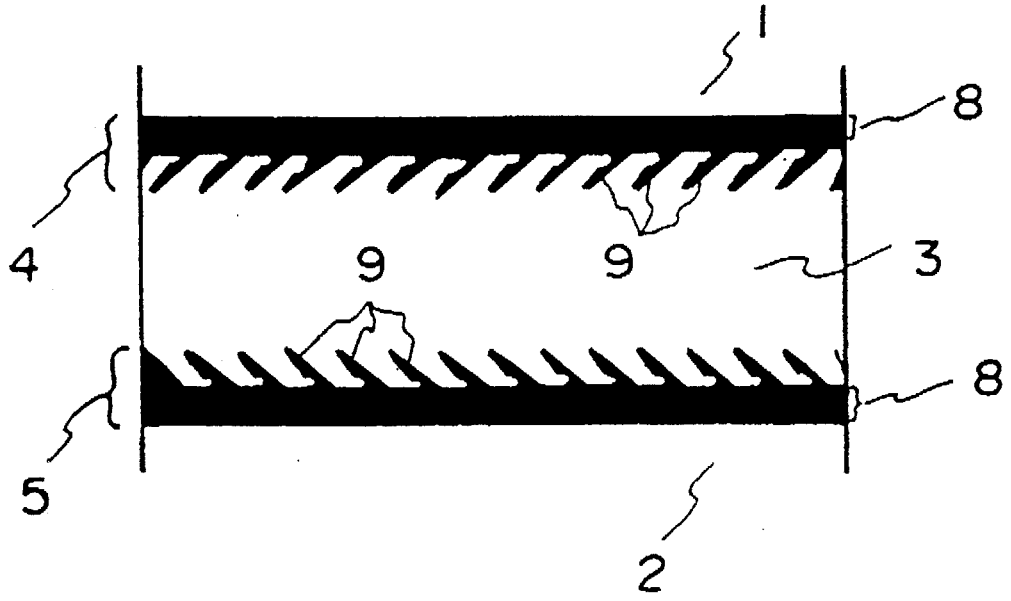
FIG. 4 is an enlarged front view showing a tearable guarantee strip and adjacent portion of the capsule according to another example of the invention, and in which each weakening line comprises linear compressed parts and saw-tooth-like compressed part disposed more closely.

As illustrated in FIG. 3 or 4, the weakening line 5 comprises a linear compressed part 8 disposed at the boundary between the tearable guarantee strip 3 and the skirt portion 2, and saw-tooth-like compressed parts 9 serrating from the linear compressed part 8 to the tearable guarantee strip 3 side. This arrangement of the weakening line 5 is intended to make it difficult to form large and sharp burrs on the upper edge of the skirt portion 2. On the other hand, as for the weakening line 4 disposed at the boundary between the cap portion 1 and the tearable guarantee strip 3, any arrangement may be freely employed. However, since it is also desired to make it difficult to form large and sharp burrs on the lower edge of the cap portion 1, it is preferable that the weakening line 4 is also arranged in the same manner as the mentioned weakening line 5. In other words, the weakening line 4 is preferably comprised of the linear compressed part 8 disposed at the boundary between the tearable guarantee strip 3 and the cap portion 1, and the saw-tooth-like compressed parts 9 serrating from the linear compressed part 8 to the tearable guarantee strip 3 side. The linear compressed part 8 and the saw-tooth-like compressed parts 9 are both formed by compressing a region of the tearable guarantee strip 3 in the direction of thickness. In such compression, a wedge-shaped cutting edge with a sharp tip end is generally used. Compressive force to be applied for forming the linear compressed parts 8 may be either the same as or different from that for forming the saw-tooth-like parts 9. It is particularly preferable that that compressive force to be applied for forming the saw-tooth-like compressed parts 9 is higher than that to be applied for forming the linear compressed part 8. Because, if a higher compressive force is applied for forming the linear compressed part 8, the linear compressed part 8 is easily broken, and there is a possibility of breaking the linear compressed part 8 without cooperation with the saw-tooth-like compressed parts 9, thereby causing the upper edge of the skirt portion 2 to be sharp-edged, eventually resulting in the danger of injuring a finger. It is also capable that, in the process of compressing the saw-tooth-like compressed parts 9, the saw-tooth-like compressed parts 9 are partially perforated by applying a very high pressure thereto. As is obvious from the above description, any desired opening or unsealing characteristic may be applied to the capsule by adjusting or varying the strength of the compressive force applied between the linear compressive part 8 and the saw-tooth-like compressed parts 9.

Figure 8:
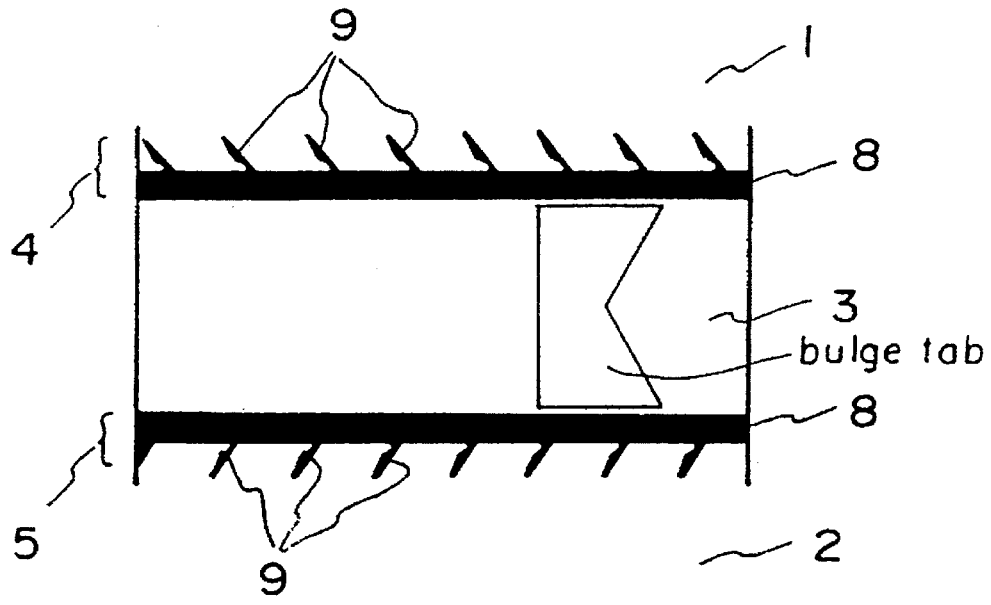
FIG. 8 is an enlarged front view of a tearable guarantee strip and adjacent portions of the capsule according to another example of the present invention, and in which each weakening line comprises a linear compressed part and saw-tooth-like compressed parts.

It is also possible that, as illustrated in FIG. 8, the weakening line 5 comprise a linear compressed part 8 disposed at the boundary between the tearable guarantee strip 3 and the skirt portion 2, and saw-tooth-like compressed parts 9 serrating from the linear compressed part 8 to the skirt portion 2 side. As a result of such an arrangement, it is difficult for any burrs to come out on the upper edge of the skirt portion 2. Also in this case, with regard to the weakening line 4 disposed at the tearable guarantee strip 3 and the cap portion 1, any arrangement may be employed. However, since it is desired to make it difficult to form burrs on the lower edge of the cap portion 1, it is preferable that the weakening line 4 comprises a linear compressed part 8 disposed at the boundary between the tearable guarantee strip 3 and the cap portion 1, and the saw-tooth-like compressed parts 9.

As for specific examples of the mentioned arrangement of the linear compressed part 8 and the saw-tooth-like compressed parts 9 forming the weakening lines 4 and 5, FIGS. 3, 4 and 8, respectively show several examples. Each of the weakening lines illustrated in FIGS. 3 and 8 comprises the linear compressed part 8 and the saw-tooth-like compressed parts 9, and a flat line is formed between one saw tooth and another in the saw-tooth-like parts 9. Each of the weakening lines 4 and 5 illustrated in FIG. 4 also comprises linear compressed part 8 and saw-tooth-like compressed parts 9, but the saw-tooth-like compressed parts 9 are closely or densely disposed and no flat line is formed between one saw tooth and another. In addition, the width of the linear compressed part 8, the serrating length of the saw-tooth-like compressed parts 9, the pitch of the saw-tooth-like compressed parts 9, etc. may be freely selected.

In the weakening lines comprising the linear and saw-tooth-like compressed parts as described above, when trying to tear the tearable guarantee strip along the weakening lines by pulling the tearable guarantee strip outwardly, the tearable guarantee strip may be easily torn due to the linear compressed part disposed throughout the saw teeth of the saw-tooth-like compressed parts. If no linear compressed part is disposed, every portion between one saw tooth and another of the saw-tooth-like parts 9 is not easily torn or removed, but some large force will be applied from outside to the portion between one saw tooth and another, resulting in unnecessary formation of large and sharp burrs. In this respect, the capsule according to the present invention may effectively prevent every non-compressed part from forming considerable outward protrusion by the existance of the linear compressed part, when applying some large force from outside. In effect, burrs formed by the outward protrusion of the non-compressed parts are relatively small and round. Accordingly, when employing the capsule according to the present invention, an advantage is such that there is no feeling of pain when touching the upper edge of the skirt portion of the capsule left on the bottle after opening it. This advantage of feeling no pain as mentioned above is also exhibited at the time of disposing of the removed tearable guarantee strip and cap portion, as a result of arranging the weakening line disposed at the boundary between the tearable guarantee strip and the cap portion as described above.

Figure 9:
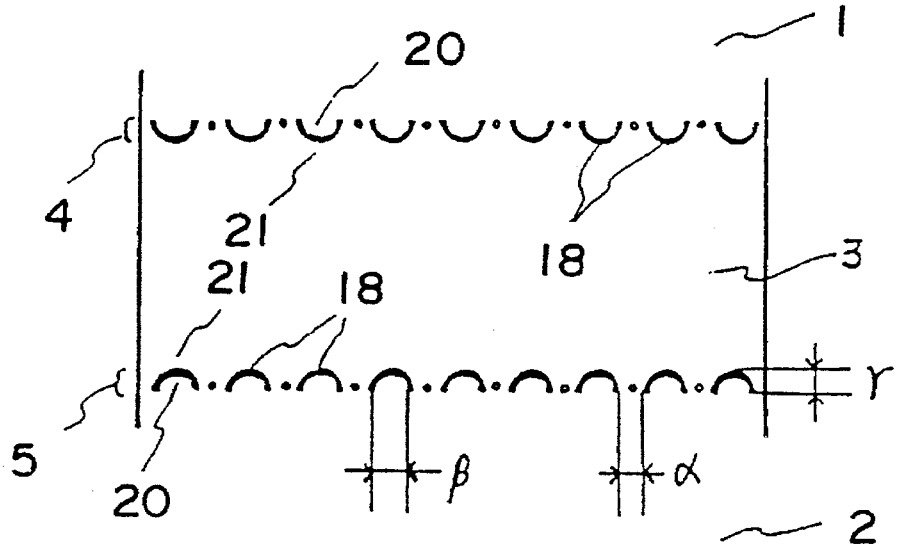
FIG. 9 is an enlarged front view of a tearable guarantee strip and adjacent portion of the capsule according to a further example of the present invention, and in which each weakening line comprises circular arc compressed parts.

The weakening line 5 may comprise a plurality of circular arc compressed parts 18 each disposed with a certain distance between one circular arc and another so that each arc of the circular arc compressed parts 18 is drawn on the tearable guarantee strip 3 side, as illustrated in FIG. 9. These circular arc compressed parts 18 are formed by compression in the shape of the circular arc without compressing outside region 21 and inside region 20 thereof. The weakening line 5 is formed as mentioned above because even if any burr is formed on the upper edge of the skirt 2 portion from the non-compressed part between one circular arc compressed part 18 and another at the time of tearing along the weakening line 5, a non-compressed circular arc portion 20 located inside the circular arc compressed part 18 will protrude by than the formed burr. If the inside 20 of the circular arc compressed part 18 should protrude outwardly, no pain will be felt in any finger or no finger will be injured when touching the inside 20 because of its circular arc shape. Distance $\alpha$ between adjacent circular arc compressed parts and, chord length $\beta$ of each circular arc compressed part 18, and height $\gamma$ thereof may be freely selected, based on consideration of material, etc. of the capsule so as to be easy to tear. It is preferable that the chord of every circular arc compressed part 18 is located in a row. It is further preferable to additionally provide dot-like holes or compressed parts each between the circular arc compressed parts adjacent each other so as to be easier to tear the tearable guarantee strip 3.

Arrangement of the weakening line 4 formed between the cap portion 1 and the tearable guarantee strip 3 may be freely selected, in case of forming the weakening line 5 of the circular arc compressed parts 18. It is preferable that this weakening line 4 is arranged in the same manner as the mentioned weakening line 5. More specifically, as illustrated in FIG. 9, the weakening line 4 preferably comprises a plurality of circular arc compressed parts 18 each disposed with a certain distance so that each arc of the circular arc compressed parts 18 is drawn on the tearable guarantee strip 3 side. In the weakening line 4 of such an arrangement, a non-compressed circular arc portion 20 which is located inside the circular arc compressed part 18 will protrude outwardly to a great extent than the burr formed at the non-compressed portion between one circular arc compressed part 18 and another. In this regard, the circular arc compressed parts 18 formed between the cap portion 1 and the tearable guarantee strip 3 and the circular arc compressed parts 18 formed between the skirt portion 2 and the tearable guarantee strip 3 may both be formed by compression with a semi-circular cylindrical cutter the tip end of which is sharpened like a graver. In compression, it is preferable to apply a strong compressive force so that the circular arc compressed parts 18 are partially formed into through holes. By such formation, the tearable guarantee strip 3 is easy to tear along the weakening lines 4 and 5. It is to be noted that "the circular arc" used herein includes not only a perfect circular arc but also a U-shape, oval in section.

It is also possible to provide the weakening lines 4 and 5 in the form of circular arc holes instead of the circular arc compressed parts 18. The circular arc compressed parts 18 are formed by compression as mentioned above. On the other hand, the circular arc holes are provided by punching. Accordingly, holes of perfect circular arc are formed on the required portion, being different from the holes formed in the circular arc compressed parts 18 by strong compression.

Since the weakening lines are formed of a large number of circular arc compressed parts or circular arc punched hole parts as illustrated in FIG. 9, when tearing along the weakening lines, the non-compressed parts or non-punched parts inside the circular arc compressed or punched hole parts protrude outwardly thereby each forming a circular arc protrusion. Such circular arc protrusions are larger than the sharpened burrs formed by protruding the non-compressed parts between one circular arc compressed part and another. Accordingly, when touching the upper edge of the skirt portion with a finger, the touched part is a circular arc protrusion having a round end, and there is almost no possibility of touching the dangerous sharpened burrs. Thus, an advantage is exhibited such that fingers are effectively prevented from feeling pain or being injured.

As for the material for the capsule, a metallic foil of 100% by weight of tin or alloy thereof is mainly used. It is also possible to use a foil of 100% by weight of aluminum or alloy thereof. The conventionally used foil of 100% by weight of lead or alloy thereof can be used as a material of capsule as a matter of course. It is also capable to use any of these metallic foils coated with a synthetic resin film. The thickness of the metallic foil is preferably not more than 200 μm. If the thickness of the metallic foil is more than 200 μm, the capsule will be excessively hard, and the tearable guarantee strip 3 tends to be difficult to be torn along the weakening lines 4 and 5.

EXAMPLES

Examples 1 to 4 and Comparative Examples 1 to 5 are summarized in the following tables 1–3.

Figure 2:
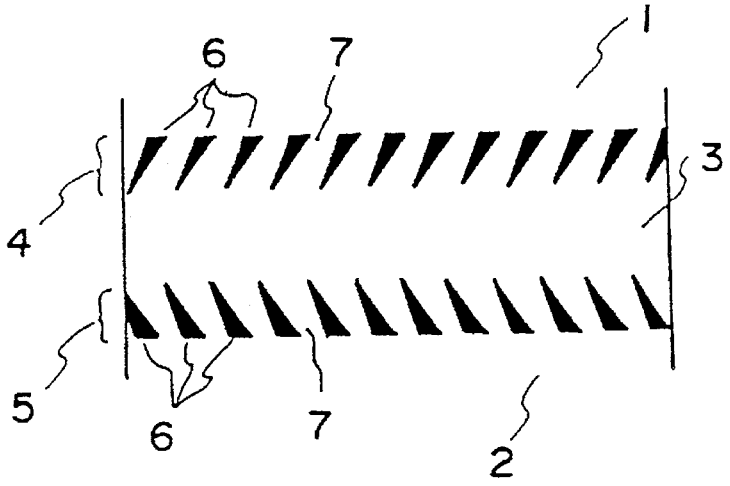
(PRIOR ART) FIG. 2
FIG. 2 is an enlarged front view showing a tearable guarantee strip and adjacent portion of the capsule according to the prior art, and in which each weakening line comprises saw-tooth-like compressed parts only.
Figure 5:
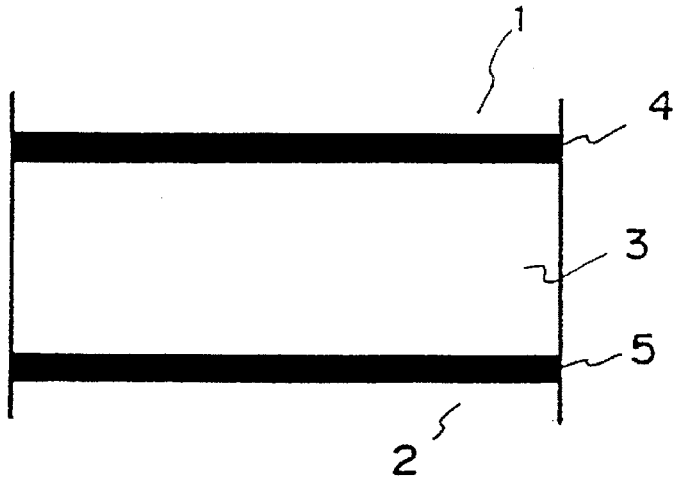
FIG. 5 is an enlarged front view showing a tearable guarantee strip of the capsule prepared as a comparative example, and in which each weakening line comprises a linear compressed part only.

Capsules each of 150 μm in thickness at the weakening lines were prepared by molding using a tin foil of 200 μm in thickness. Each capsule was provided with weakening lines 4 and 5 illustrated in FIG. 3 (Examples 1 to 4). Different capsules each provided with the weakening lines 4 and 5 illustrated in FIG. 2 (Comparative Examples 1 to 4) and FIG. 5 (Comparative Example 5) were also prepared using the same tin foil as Examples 1 to 4. Tables 1 and 2 respectively show the arrangement of the weakening lines 4 and 5 of the capsule.

TABLE 1

| | | Example | | | |
|---|---|---|---|---|---|
| | | 1 | 2 | 3 | 4 |
| Width of weakening line | a | 1.5 mm | 1.0 mm | 1.5 mm | 1.5 mm |
| Width of linear compressed part | b | 0.3 mm | 0.3 mm | 0.3 mm | 0.3 mm |
| Serrating length of saw-tooth-like compressed parts | c | 1.2 mm | 0.7 mm | 1.2 mm | 1.2 mm |
| Pitch of saw-tooth-like compressed parts | d | 1.4 mm | 1.4 mm | 1.4 mm | 1.4 mm |
| Max. depth of linear compressed part | e | 100 μm | 50 μm | 100 μm | 50 μm |

TABLE 1-continued

| | | Example | | | |
|---|---|---|---|---|---|
| | | 1 | 2 | 3 | 4 |
| Max. depth of saw-tooth-like compressed parts | f | * | * | 130 μm | 130 μm |
| Max. width of saw-tooth-like compressed parts | g | 0.7 mm | 0.7 mm | 0.7 mm | 0.7 mm |
| Angle of tooth of saw-tooth-like compressed parts | h | 85° | 85° | 85° | 85° |
| Distance between linear compressed parts | | 8 mm | 10 mm | 8 mm | 10 mm |

TABLE 2

| | | Comparative Example | | | | |
|---|---|---|---|---|---|---|
| | | 1 | 2 | 3 | 4 | 5 |
| Width of weakening line | a | 1.0 mm | 1.0 mm | 1.5 mm | 1.5 mm | 0.5 mm |
| Width of linear compressed part | b | — | — | — | — | 0.5 mm |
| Serrating length of saw-tooth-like compressed parts | c | 1.0 mm | 1.0 mm | 1.5 mm | 1.5 mm | — |
| Pitch of saw-tooth-like compressed parts | d | 1.0 mm | 1.0 mm | 1.0 mm | 1.4 mm | — |
| Max. depth of linear compressed part | e | — | — | — | — | 100 μm |
| Max. depth of saw-tooth-like compressed parts | f | 100 μm | * | * | * | — |
| Max. width of saw-tooth-like compressed parts | g | 0.5 mm | 0.5 mm | 0.5 mm | 0.7 mm | — |
| Angle of tooth of saw-tooth-like compressed parts | h | 70° | 70° | 85° | 85° | — |
| Distance between linear compressed parts | | 8 mm | 8 mm | 8 mm | 8 mm | 8 mm |

Figure 6:
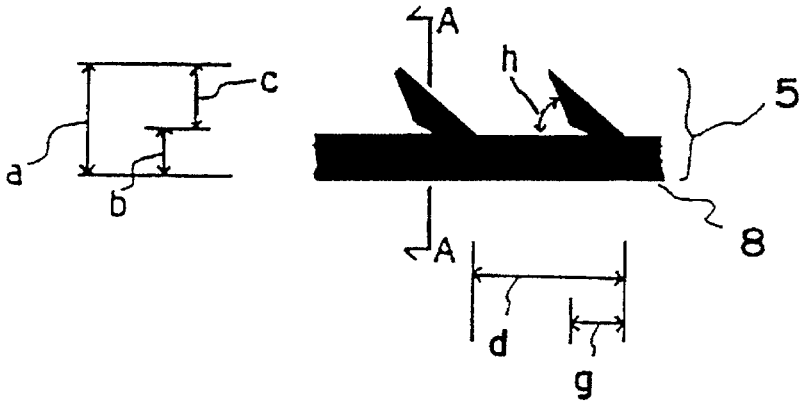
FIG. 6 is an enlarged view showing a weakening line according to example of the present invention.
Figure 7:
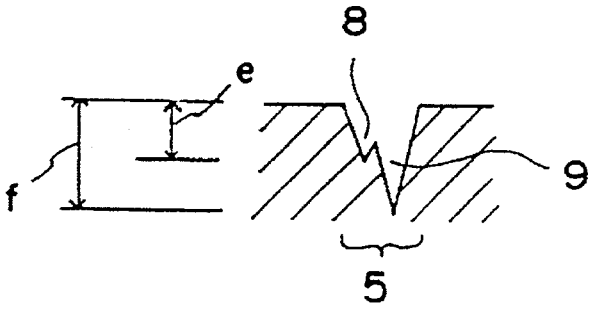
FIG. 7 is a sectional view of the weakening line taken along the line A—A in FIG. 6.

The maximum depth of the linear compressed part and that of the saw-tooth-like compressed parts shown in Tables 1 and 2 mean a distance from the deepest point to the surface since the compressed parts are wedge-shaped in the direction of thickness. In the tables, when the applied compressive force was so strong that the linear and saw-tooth-like compressive parts were partially provided with holes, depth was not measured but indicated simply by the mark * in the tables. The maximum width of the saw-tooth-like compressed parts means a distance at the widest point of each tooth. In this respect, FIGS. 6 and 7 show respectively the location of each column item in Tables 1 and 2.

With respect to every capsule obtained as mentioned above, the tearable guarantee strip was torn along the weakening lines, then the tearable guarantee strip was removed, and burrs formed on the upper edge of the skirt portion and the lower edge of the cap portion, feeling and unsealing (or opening) characteristics were evaluated. Table 3 shows the result. In this regard, a three-grade evalution was employed as to feeling, while a five-grade evaluation was employed as to the unsealing characteristic, as mentioned below.

(Feeling) 1: No pain was felt at all when touching the edge of the skirt or the like. 3: A little pain was felt when touching the cut edge of the skirt or the like. 5: A strong pain was felt when touching the cut edge of the skirt or the like.

(Unsealing characteristic) 1: Unsealing was achieved very smoothly. 2: Unsealing was achieved smoothly. 3: Unsealing was achieved with average smoothness. 4: Unsealing was achieved with a little stiffness. 5: Unsealing was achieved with a large stiffness.

TABLE 3

| | Formation of burr | Feeling | Unsealing characteristic |
|---|---|---|---|
| Example 1 | Small round burr were found | 1 | 1 |
| Example 2 | Small round burr were found | 1 | 2 |
| Example 3 | Small round burr were found | 1 | 1 |
| Example 4 | Small round burr were found | 1 | 2 |
| Comparative Example 1 | Large sharp burr were found | 5 | 5 |
| Comparative Example 2 | Large sharp burr were found | 5 | 4 |
| Comparative Example 3 | Large sharp burr were found | 5 | 4 |
| Comparative Example 4 | Large sharp burr were found | 5 | 5 |
| Comparative Example 5 | Sharp edge was formed without burr | 3 | 3 |

It is obviously understood from Table 3 that in the case of the capsules according to the Examples of the present invention, though burrs were formed, those burrs were so small and round that no pain was felt when touching them. On the other hand, with the capsule according to Comparative Examples 1 to 4, large and sharp burrs was formed, and pain was felt when touching them. In the case of the capsule according to Comparative Example 5, since the weakening lines comprise the linear compressed parts only, no burrs was formed, but the upper edge of the skirt portion and the lower edge of the cap portion were sharp-edged, and there was a feeling like injuring a finger on the sharp edge when touching them. From the viewpoint of unsealing characteristic, it is understood that the capsules according to Examples 1 to 4 were superior to those according to Comparative Examples 1 to 5.

Examples 5 to 8 and Comparative Examples 6 to 9 are summarized in the following tables 4–6.

Capsules each of 150 μm in thickness at the weakening lines were prepared by molding using a tin foil of 200 μm in thicknes. Each of these capsules was provided with weakening lines 4 and 5 illustrated in FIG. 8. Arrangement of the weakening lines 4 and 5 was changed as shown in Table 4, thus capsules according to Examples 5 to 8 being obtained. Further, capsules according to Comparative Examples 6 to 9 were also prepared, in which weakening lines were formed by removing the linear compressed parts from the weakening lines 4 and 5 illustrated in FIG. 8 (i.e., weakening lines formed by changing the weakening line 4 illustrated in FIG. 2 so that the acute angle of each saw-tooth is facing the cap portion side, and by changing the weakening line 5 illustrated in FIG. 2 so that the acute angle of each saw-tooth is facing the skirt portion side). The dimensions of each weakening line of the capsules according to these Comparative Examples 6 to 9 are as shown in Table 5.

TABLE 4

| | | Example | | | |
|---|---|---|---|---|---|
| | | 5 | 6 | 7 | 8 |
| Width of weakening line | a | 1.5 mm | 1.0 mm | 1.5 mm | 1.5 mm |
| Width of linear compressed part | b | 0.3 mm | 0.3 mm | 0.3 mm | 0.3 mm |
| Serrating length of saw-tooth-like compressed parts | c | 1.2 mm | 0.7 mm | 1.2 mm | 1.2 mm |
| Pitch of saw-tooth-like compressed parts | d | 1.4 mm | 1.4 mm | 1.4 mm | 1.4 mm |
| Max. depth of linear compressed part | e | 100 μm | 50 μm | 100 μm | 50 μm |
| Max. depth of saw-tooth-like compressed parts | f | * | * | 130 μm | 130 μm |
| Max. width of saw-tooth-like compressed parts | g | 0.7 mm | 0.7 mm | 0.7 mm | 0.7 mm |
| Angle of tooth of saw-tooth-like compressed parts | h | 85° | 85° | 85° | 85° |
| Distance between linear compressed parts | | 8 mm | 10 mm | 8 mm | 10 mm |

TABLE 5

| | | Comparative Example | | | |
|---|---|---|---|---|---|
| | | 6 | 7 | 8 | 9 |
| Width of weakening line | a | 1.0 mm | 1.0 mm | 1.5 mm | 1.5 mm |
| Width of linear compressed part | b | — | — | — | — |
| Serrating length of saw-tooth-like compressed parts | c | 1.0 mm | 1.0 mm | 1.5 mm | 1.5 mm |
| Pitch of saw-tooth-like compressed parts | d | 1.0 mm | 1.0 mm | 1.0 mm | 1.4 mm |
| Max. depth of linear compressed part | e | — | — | — | — |
| Max. depth of saw-tooth-like compressed parts | f | 100 μm | * | * | * |
| Max. width of saw-tooth-like compressed parts | g | 0.5 mm | 0.5 mm | 0.5 mm | 0.7 mm |
| Angle of tooth of saw-tooth-like compressed parts | h | 70° | 70° | 85° | 85° |
| Distance between linear compressed parts | | 8 mm | 8 mm | 8 mm | 8 mm |

With respect to every capsule obtained as mentioned above, the tearable guarantee strip was torn along the weakening lines, and the unsealing characteristic was evaluated. Then, the tearable guarantee strip was removed, and feeling for burrs formed on the upper edge of the skirt portion and the lower edge of the cap portion was evaluated. Table 6 shows the result.

TABLE 6

| | Formation of burr | Feeling | Unsealing characteristic |
|---|---|---|---|
| Example 5 | Scarcely burr were found | 1 | 1 |
| Example 6 | Scarcely burr were found | 1 | 2 |
| Example 7 | Scarcely burr were found | 1 | 1 |
| Example 8 | Scarcely burr were found | 1 | 2 |
| Comparative Example 6 | Large sharp burr were found | 5 | 5 |
| Comparative Example 7 | Large sharp burr were found | 5 | 4 |
| Comparative Example 8 | Large sharp burr were found | 5 | 4 |
| Comparative Example 9 | Large sharp fins were found | 5 | 5 |

It is obviously understood from Table 6 that in the case of the capsules according to Examples 5 to 8, since burrs were scarcely formed, no pain was felt when touching them. On the other hand, in the case of the capsules according to Comparative Examples 6 to 9, large and sharp burrs were formed, and pain was felt when touching them. Concerning the unsealing characteristic, the capaules according to Examples 5 to 8 were smoothly opened or unsealed. On the contrary, the capsules according to Comparative Examples 6 to 9 were stiff and not smoothly unsealed. In addition, every column item shown in Table 4 to 6 has the same meaning as Table 1 to 3.

Example 9 to 12

Capsules each of 150 μm in thickness at the weaking lines were prepared, by molding using a tin foil of 200 μm in thickness. Each of these capsules was provided with weakening lines 4 and 5 illustrated in FIG. 9. Distance α between one circular arc compressed part and an adjacent one, chord length β of each circular arc compressed part, and height γ of each circular arc compressed part were as shown in Table 7.

TABLE 7

| | | 9 | 10 | 11 | 12 |
|---|---|---|---|---|---|
| Distance between one circular arc compressed part and adjacent another | α | 0.3 mm | 0.3 mm | 0.6 mm | 0.6 mm |
| Chord length of circular arc compressed part | β | 1.0 mm | 1.0 mm | 1.0 mm | 0.8 mm |
| Height of circular arc compressed part | γ | 0.8 mm | 0.8 mm | 0.8 mm | 1.0 mm |
| Depth of circular arc compressed part | | * | 130 μm | ** | 130 μm |
| Distance between weakening lines | | 8 mm | 10 mm | 10 mm | 10 mm |

In Table 7, the mark ** indicates a circular arc hole provided by punching in place of a circular arc compressed part.

With respect to the capsules according to Examples 9 to 12, evalution was carried out feeling for the formation of burrs and unsealing characteristic. Table 8 shows the results.

TABLE 8

| | Formation of burr | Feeling | Unsealing characteristic |
|---|---|---|---|
| Example 9 | Burr were found between one circular arc compressed part and adjacent another | 1 | 1 |
| Example 10 | Burr were found between one circular arc compressed part and adjacent another | 1 | 1 |
| Example 11 | Burr were found between one circular arc compressed part and adjacent another | 1 | 1 |
| Example 12 | Burr were found between one circular arc compressed part and adjacent another | 1 | 2 |

It is obviously understood from Table 8 that in the case of the capsules according to Examples 9 to 12, though burrs were formed, circular arc protrusions protruding outwardly were also formed which protruded outwardly more than the burrs, and therefore no pain was felt when touching them. On the other hand, as is obvious from Table 3, in the case of the capsules according to Comparative Examples 1 and 2, burrs with sharp points were formed, and pain was felt touching them. Concerning the unsealing characteristic, the capsules according to Examples 9 to 12 were smoothly unsealed. On the contrary, the capsules according to Comparative Examples 1 and 2 were stiff and not smoothly unsealed.

What is claimed is:

1. A capsule for a bottle neck, comprising:

a cap portion;

a skirt portion; and a tearable guarantee strip connecting said cap portion and said skirt portion, said tearable guarantee strip comprising weakening lines formed respectively at the boundary between said tearable guarantee strip and said cap portion and at the boundary between said tearable guarantee strip and said skirt portion, an under weakening line formed at the boundary between said tearable guarantee strip and said skirt portion having a linear compressed part extending along said boundary between said tearable guarantee strip and said skirt portion, and saw-tooth-like compressed parts serrating from said linear compressed part into said tearable guarantee strip, and said saw-tooth-like compressed parts compressed to a greater extent than said linear compressed part.

2. A capsule as set forth in claim 1, wherein the upper weakening line formed at the boundary between said tearable guarantee strip and said cap portion has a linear compressed part extending along said boundary between said tearable guarantee strip and said cap portion, and saw-tooth-like compressed parts serrating from said linear compressed part into said tearable guarantee strip.

3. A capsule as set forth in claim 1, wherein the upper weakening line formed at the boundary between said tearable guarantee strip and said cap portion has a linear compressed part extending along said boundary between said tearable guarantee strip and said cap portion, and saw-tooth-like compressed parts serrating from said linear compressed part into said tearable guarantee strip, said saw-tooth-like compressed parts being compressed to a greater extent than said linear compressed part.

* * * * *